US011661869B1

(12) United States Patent
Hudnall et al.

(10) Patent No.: US 11,661,869 B1
(45) Date of Patent: May 30, 2023

(54) OIL PAN ASSEMBLY

(71) Applicant: Holley Performance Products, Inc., Bowling Green, KY (US)

(72) Inventors: Coy Hudnall, Bowling Green, KY (US); Kevin Tracy, Port Charlotte, FL (US)

(73) Assignee: Holley Performance Products, Inc., Bowling Green, KY (US)

( * ) Notice: Subject to any disclaimer, the term of this patent is extended or adjusted under 35 U.S.C. 154(b) by 0 days.

(21) Appl. No.: 17/468,227

(22) Filed: Sep. 7, 2021

Related U.S. Application Data

(60) Provisional application No. 63/075,637, filed on Sep. 8, 2020.

(51) Int. Cl.
*F01M 11/00* (2006.01)

(52) U.S. Cl.
CPC . *F01M 11/0004* (2013.01); *F01M 2011/0033* (2013.01)

(58) Field of Classification Search
CPC ..... F01M 11/0004; F01M 2011/0033; F16N 31/00
See application file for complete search history.

(56) References Cited

U.S. PATENT DOCUMENTS

| | | | | |
|---|---|---|---|---|
| 7,341,039 | B1 * | 3/2008 | Jaszewski | F01M 11/0004 123/196 R |
| D660,892 | S | 5/2012 | Tomlinson | |
| D842,911 | S | 3/2019 | O'Neill | |
| 11,022,011 | B2 * | 6/2021 | Lechartier | F01M 5/021 |
| 2012/0067322 | A1 * | 3/2012 | Andersson | F01M 11/0004 206/521 |

FOREIGN PATENT DOCUMENTS

| | | |
|---|---|---|
| AU | 341123 | 2/2012 |
| AU | 201717295 | 12/2017 |
| AU | 201717297 | 12/2017 |
| AU | 201717299 | 12/2017 |

OTHER PUBLICATIONS

Holley Product Catalog—Oil Pans—2016.
U.S. Appl. No. 17/468,227, filed Sep. 7, 2021 titled Oil Pan Assembly.
Design U.S. Appl. No. 29/749,677, filed Sep. 8, 2020 titled Oil Pan.
U.S. Appl. No. 63/075,637, filed Sep. 8, 2020 titled Oil Pan.

* cited by examiner

*Primary Examiner* — Syed O Hasan
(74) *Attorney, Agent, or Firm* — Dinsmore & Shohl LLP

(57) ABSTRACT

Present embodiments relate to an oil pan assembly. More specifically, but without limitation, present embodiments relate to an oil pan assembly including a windage tray which cooperates with the oil pan.

14 Claims, 4 Drawing Sheets

OIL PAN ASSEMBLY

CLAIM TO PRIORITY

This non-provisional patent application claims priority to and benefit of, under 35 U.S.C. § 119(e), U.S. Provisional Patent Application Ser. No. 63/075,637, filed Sep. 8, 2020 and titled "Oil Pan Assembly", all of which is incorporated by reference herein.

CROSS-REFERENCE

Cross-reference is made to U.S. Design patent application No. 29/749,677, filed on Sep. 8, 2020, and titled "Oil Pan," all of which is expressly incorporated herein by reference.

BACKGROUND

1. Field of the Invention

Present embodiments relate to an oil pan assembly. More specifically, but without limitation, present embodiments relate to an oil pan assembly including a windage tray which cooperates with the oil pan.

2. Description of the Related Art

Internal combustion engines, including diesel engines, use lubricating oil for many purposes including for example, lubricating moving parts. Typically, an oil pan is connected to the engine, for example disposed beneath a cylinder block and crankshaft of an internal combustion engine. The oil sump is configured to receive oil that drains or is otherwise exhausted from the cylinder block, crankshaft and/or main bearings that support the crankshaft. The oil collects in a sump of the oil pan, after being slung from the crankshaft or otherwise draining, and is then pumped from a sump pick-up location into a lubrication system associated with the engine.

When higher horsepower engines are built, it may be desirable to increase the diameter of the crankshaft or adjacent parts. However, the oil sump may have to be varied in shape to accommodate such.

SUMMARY

The present embodiments provide an oil pan assembly which is located adjacent to an engine. The oil pan assembly may include the sump and a windage tray, which reduces air flow disturbance of oil within the sump. A windage tray locating and securing technique/design incorporates tabs that are located into pockets to vertically secure. The windage tray may include a plurality of tabs that locate the tray relative to a flange of the oil pan. Additionally, the sump may include inserts which apply a biasing force against the windage tray when the oil pan is connected to the engine. The windage tray may also include features which locate the tray relative to the oil pan. A compressible spring element is provided to the lower surface of this pocket to close any gap resulting from manufacturing of the related components. This spring element pushes the tabs upward to the engine flange and fills any gap between the tab and pan. To assure these tabs do not get horizontally outside of the intended pocket during assembly, additional horizontal alignment locator tabs on the windage tray mate to notches in the pan. These horizontal locating tabs may be shaped so that the tabs find or locate (center relative to) the notches. The result of the above is a positively located windage tray that will not move during engine function and not be an element in vertical stacking and tolerances.

According to some embodiments, a windage tray comprises a panel having a curved surface extending between a first edge and a second parallel edge, a plurality of tabs disposed along each of the first edge and the second parallel edge, at least one locator disposed along each of the first edge and the second parallel edge.

According to some optional embodiments, the following feature may be utilized with the windage tray either alone or in combination with other features. The plurality of tabs may comprise a first size tab and a second size tab. The plurality of tabs may be differing in orientation in at least two locations along each edge, so that the windage tray is capable of proper orientation in one direction. One of the plurality of tabs at one end of one of the first or second edges differs in size from a second of the plurality of tabs at a second end of the one of the first or second edges. The plurality of tabs may comprise a single size. The at least one locator being angled relative to an adjacent tab to provide a centering function. The windage tray may further comprise a plurality of holes along one side of the windage tray. The windage tray may further comprise a plurality of apertures in the panel, at least one of the apertures having a cover spaced from the aperture.

According to some embodiments, an oil pan assembly comprises an oil pan with a flange about an upper perimeter of the oil pan, a windage tray disposed along an inside upper perimeter of the oil pan, a plurality of tabs disposed along each of two parallel edges of the windage tray, a plurality of pockets disposed along the an upper surface of the flange, at least one slot disposed in the plurality of pockets, a crush insert disposed in each slot and engaging an undersurface of each of the plurality of tabs.

According to some optional embodiments, the following feature may be utilized with the windage tray either alone or in combination with other features. The oil pan assembly further comprising a locator at one end of each of parallel edge of the windage tray. The flange further comprising a perimeter seat for a seal. The plurality of tabs comprising at least a first size and a second size. At least one tab of the plurality of tabs having a first orientation and at least one second tab of the plurality of tabs having a second orientation. The windage tray may only be properly seated in the flange in one direction.

BRIEF DESCRIPTION OF THE DRAWINGS

In order that the embodiments may be better understood, embodiments of an oil pan assembly will now be described by way of examples. These embodiments are not to limit the scope of the claims as other embodiments of an oil pan assembly will become apparent to one having ordinary skill in the art upon reading the instant description. Non-limiting examples of the present embodiments are shown in figures wherein:

DETAILED DESCRIPTION

Figure 1:
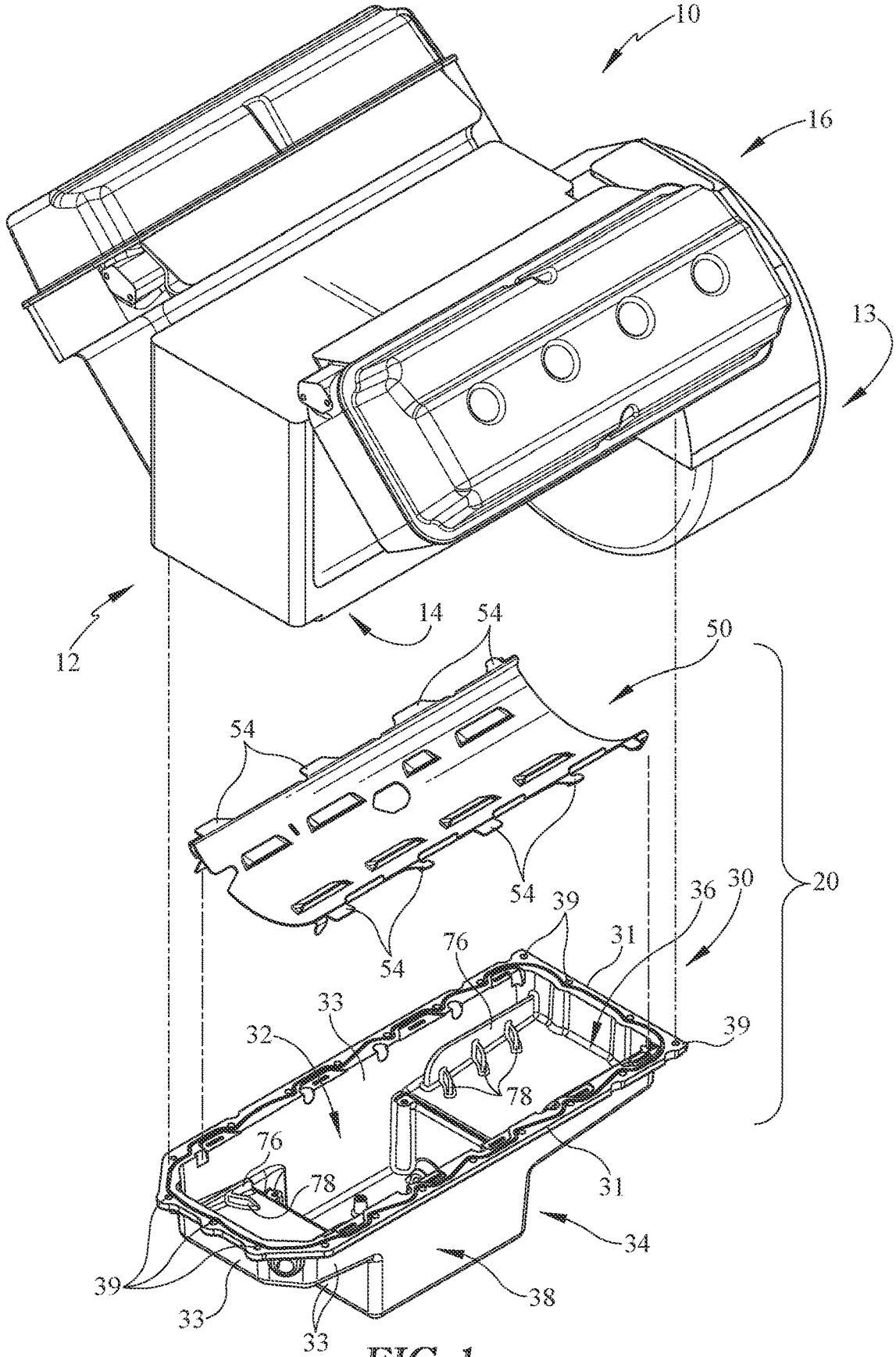
FIG. 1 is an exploded perspective view of an engine and oil pan assembly.

It is to be understood that an oil pan assembly is not limited in its application to the details of construction and the arrangement of components set forth in the following description or illustrated in the drawings. The described embodiments are capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Reference throughout this specification to "one embodiment", "some embodiments" or "an embodiment" means that a particular feature, structure or characteristic described in connection with the embodiment is included in at least one embodiment of the present invention. Thus, appearances of the phrases "in one embodiment", "in some embodiments" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Referring now to FIGS. 1-4, an oil pan assembly is provided which utilizes an oil pan and windage tray. The windage tray is provided with a plurality of tabs which seat within pockets to bias the windage tray when the oil pan assembly is fastened to an engine. Features are provided which also locate the windage tray relative to the oil pan and so that the tray may only be oriented in one, correct manner.

Referring now to FIG. 1, an exploded perspective view of an engine 10 is provided which may include an example oil pan assembly 20. The oil pan assembly 20 is shown comprising an oil pan 30 and a windage tray 50.

The engine 10 is shown in an engine block 12 form with numerous parts removed. The engine block 12 may have a plurality of cylinders (not shown) formed therein. The engine may be, for non-limiting example, a four cylinder, six cylinder, or an eight cylinder engine. At one end 16 of the engine block 12, a transmission may be connected by clutch or torque converter 13 and along a bottom 14 of the engine block 12, the oil pan assembly 20 may be located. The location of the oil pan assembly 20, however, is not limited to the bottom 14 and may be at other locations depending on the configuration of the engine block 12 and the engine design.

The engine block 12 and other parts associated with the engine may have a plurality of lubricating passages through which oil is pumped. Upon circulating through the engine, and lubricating parts, the oil returns to the oil pan assembly 20.

Below the engine block 12 is the oil pan assembly 20 which is exploded. The windage tray 50 is shown first and covers an upper opening 32 in the oil pan 30. The windage tray 50 limits force effects within the oil pan 30 created by the crank, crankcase, and pistons, and limits infusion of air into the oil in the oil pan 30.

The windage tray 50 fits within a flange or lip 31 of the oil pan 30. The windage tray 50 has a plurality of tabs 54 which are received within pockets 44 (FIG. 3) formed in the flange or lip 31. The windage tray 50 has a generally rectangular shape, corresponding to the shape of an opening in the bottom of the engine block 12. The windage tray 50 may comprise a plurality of edges 52 that define the example rectangular shape. The windage tray 50 may also comprise a curved surface which generally follows the curvature of the crank (not shown), so that the two of the parallel edges 52 of the windage tray 50 may comprise a plurality of tabs 54. The tabs 54 may comprise various sizes and shapes, and in some embodiments the sizes and shapes may all be the same or may differ in whole or in part. In the depicted embodiments, the plurality of tabs 54 may comprise various shapes. The tabs 54 may be shaped and/or sized to fit and in corresponding oil pan 30.

Beneath the windage tray is the oil pan 30. The oil pan 30 is shown as a mid-sump oil pan but alternatively, may be a front or rear sump embodiment. The oil pan 30 has a long dimension and short dimension defining a rectangular shape at an upper periphery of the oil pan. The oil pan 30 may be cast, stamped, or forged for example. The oil pan 30 comprises a flange or lip 31 that surrounds the upper opening 32, and a body 34 defined by a plurality of sidewalls 33 depending from the flange or lip 31. The oil pan 30 may have one level or may have one or more upper level 36 and a sump 38 as shown. The upper opening 32 corresponds to the windage tray 50, so that the windage tray 50 covers a large portion of the upper opening. The windage tray 50 limits air and pressure effects in the oil pan 30.

The upper portion 36 may include long baffles 76 which are depicted spaced from inner sides of the sidewalls 33 of the oil pan 30 in the upper portion. The long baffles 76 further comprise short ribs or baffles 78 extending therefrom. As the oil falls into the upper portion 36, the oil is desired to move to the sump 38 for pick up and pumping to through the engine 10. The baffles 76, 78 guide oil toward the sump 38.

Figure 2:
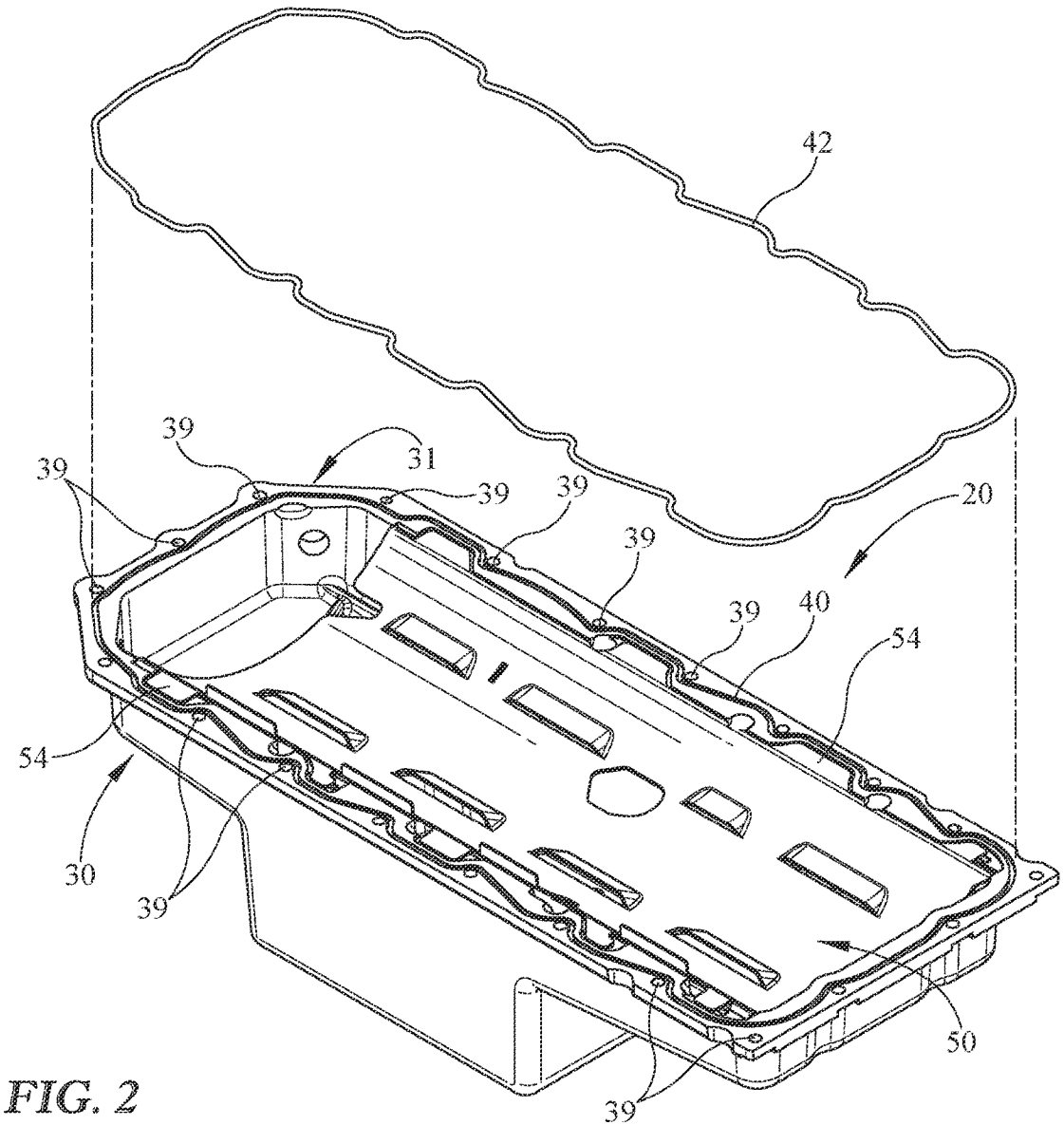
FIG. 2 is a perspective view of the oil pan assembly.

Referring now to FIG. 2, the oil pan assembly 20 is shown in perspective view. In this assembly view, the windage tray 50 is disposed in the oil pan 30. The oil pan 30 includes the flange or lip 31 and a plurality of fastener apertures 39. The flange 31 also includes a groove 40 which extends about the flange 31 and receives a seal 42, for example an O-ring seal. Other seals may be utilized however. The groove 40 may be curvilinear and extends about the periphery of the flange or lip 31, and moves around the apertures 39 and the pockets 44. While the groove 40 is shown in a specific shape, it should be understood that the shape may vary. The seal 42 inhibits oil from escaping from between the oil pan 30 and the engine block 12 (FIG. 1).

The flange 31 further comprises a plurality of pockets 44. The tabs 54 may be received by the pockets 44 so that the windage tray 50 is located and seated relative to the oil pan 30. The pockets 44 may be of various size and shape. For example, the sizes and shapes may all be the same or the sizes and shapes of the pockets 44 may differ. In the instant embodiment, the pockets 44 differ in size and shape and as a result, the windage tray 50 will only locate and sit properly in one orientation. For example, along one side of the windage tray 50, some of the tabs 54 are trapezoidal in shape, while on the opposite side of the windage tray 50, some of the tabs 54 are rectangular. Still further, other tabs may be other shapes, all of which aid to ensure the windage tray 50 is oriented appropriately relative to the oil pan 30. While the tabs 54 may aid to ensure proper orientation, the tab 54 may not touch the edges of the pockets 44. Instead the pockets 44 may be slightly oversized relative to the tabs 54.

Figure 4:
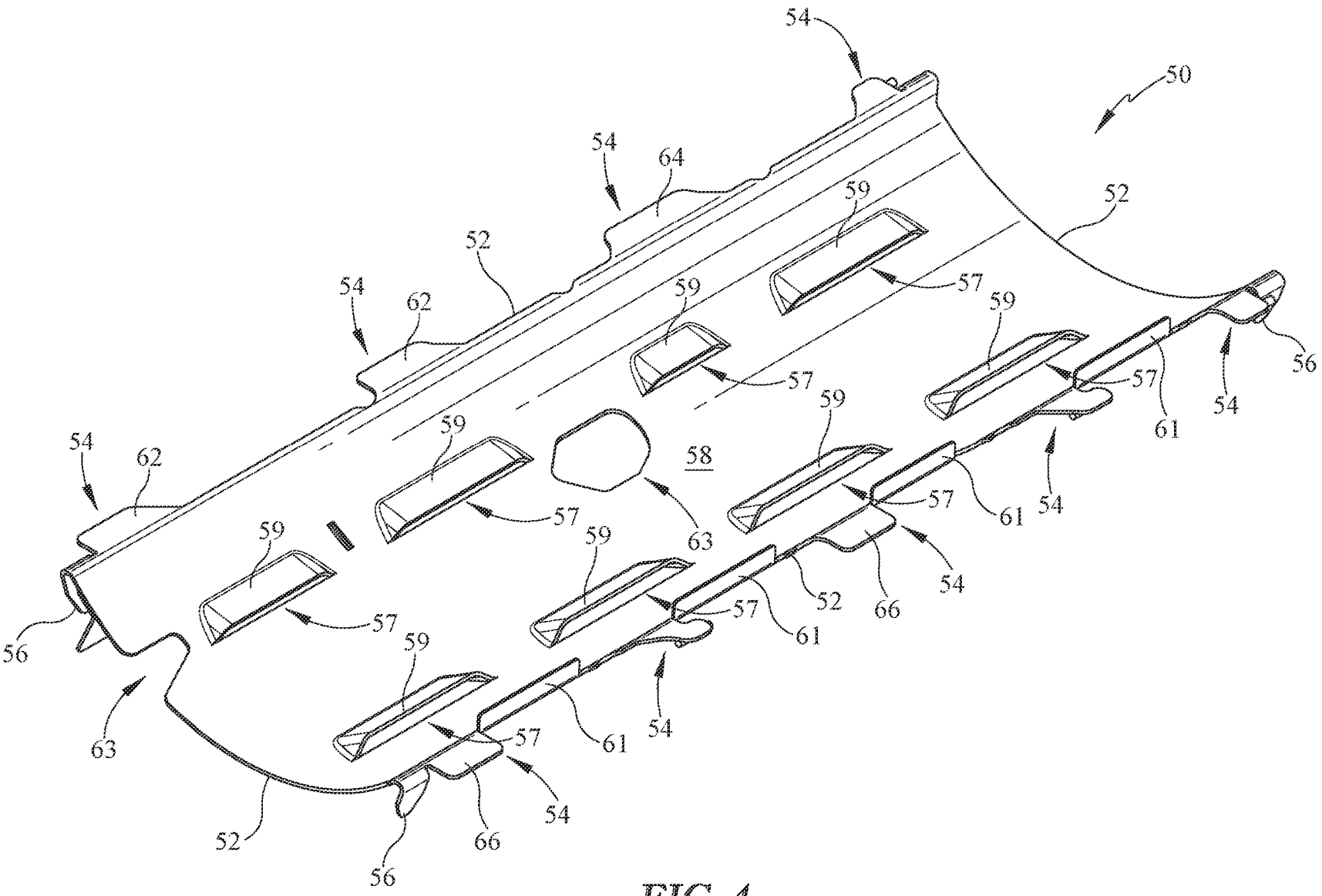
FIG. 4 is a perspective view of a windage tray.

The windage tray 50 includes the plurality of locators 56 (FIG. 4). The locators 56 are shown at ends of the edges of the windage tray 50. The locators 56 are folded downward relative to an adjacent tab 54 and may engage a sidewall or notch 49 of the oil pan 30, and may additionally have a centering function for the windage tray 50 relative to the oil pan 30. The locators 56 have a horizontally aligning function relative to the pan 30, so that once properly aligned, the tabs 54 are aligned with the pockets 44 and cannot be positioned outside of the pockets 44 nor between the pan flange 31 and a flange on the engine bottom 14. This further allows for proper sealing between the o-ring seal 42 and a flange on the engine bottom 14.

Figure 3:
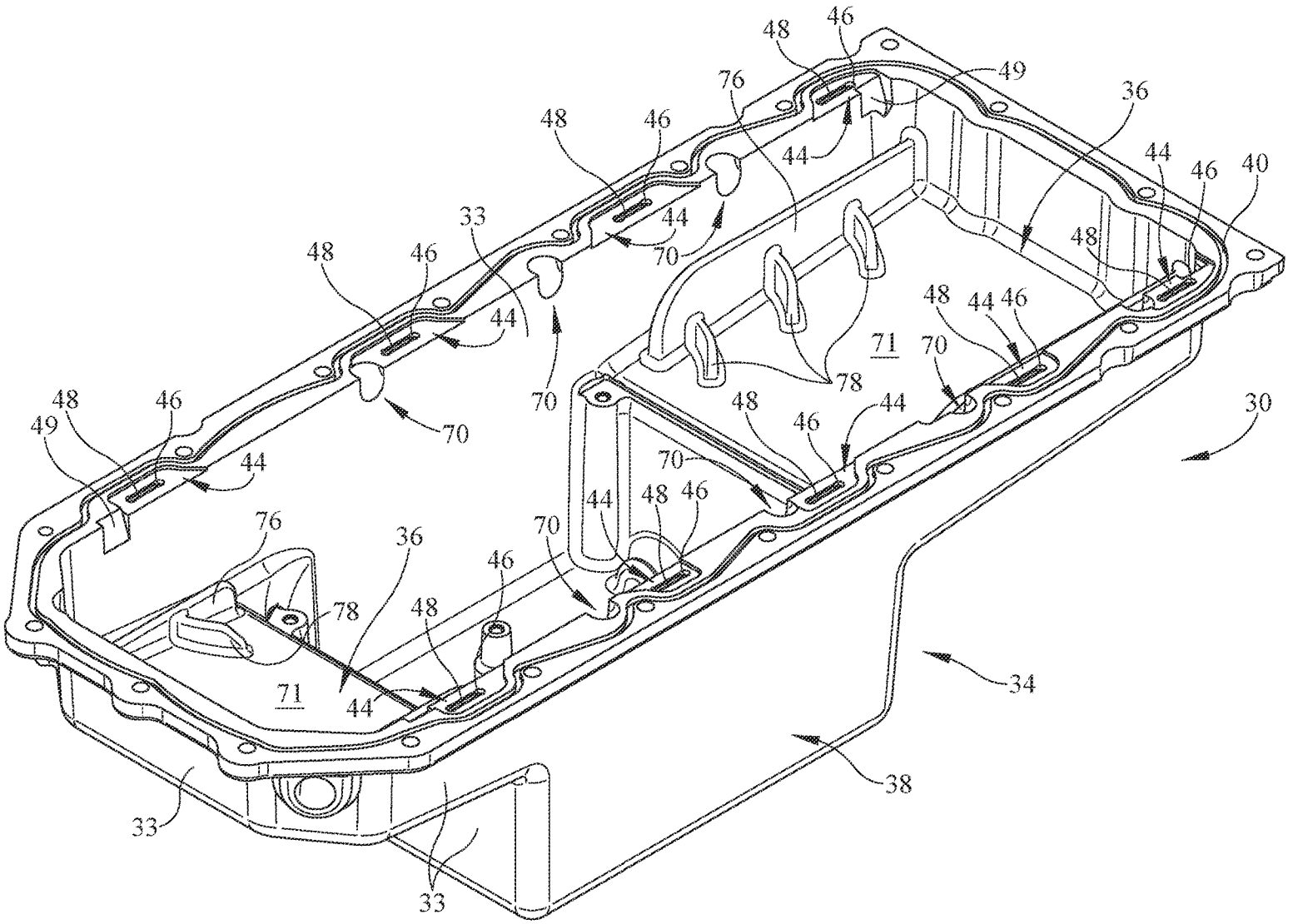
FIG. 3 is a perspective view of an oil pan.

Referring now to FIG. 3, the oil pan 30 is shown with the windage tray 50 removed. The pockets 44 are shown more clearly. The pocket 44 on one side of the flange 31 may or may not be opposite to the pocket 44 on the opposite edge of the flange 31. Further, the shape of the pockets 44 may differ. This provides for a corresponding fit relative to the windage tray 50.

Within the pockets 44 are insert slots 46. Each of the insert slots 46 may include an insert 48, for example a rubber, plastic, elastic, or other material which can exert a biasing force on the tabs 54 of the windage tray 50. The inserts 48 may be placed in the slots 46 and may extend into the pocket 44 so that the tabs 54 rest on the insert 48. The inserts 48 provide a biasing force against the tabs 54 when the oil pan assembly 20 is torqued against the engine block 12.

The locator notches 49 are also shown at ends of the long edges of the oil pan 30. The notches 49 may be angled slightly matching the angle of the locators 56 to horizontally align the tray 50 relative to the pan 30. Together these features aid to center the windage tray 50 within the opening of the oil pan 30. The locators 56 are tabs which are folded to seat in notches 49 of the oil pan 30. When the locators 56 are located appropriately, the tabs 54 are aligned to seat in the pockets 44. Once seated, the inserts 48 close any gap between the tabs 54 and the oil pan 30. As a result of the assembly, the windage tray 50 will be positively located and will not move during engine function. There will not be vertical stacking and tolerance issues between the engine bottom flange 14, windage tray 50, and the oil pan 30. Stacking is generally understood to be interfaces between pairs of parts or surfaces, which increase with the addition of more parts in an area.

Additional notches or scallops 70 may be located along the pan 30. For example, at the intersection of the flange 31 and the body 34, of the oil pan 30, there may be the scallops or other drain path structures 70, so that oil can return from the pockets 44 or between the windage tray 50 and the flange 31.

The oil pan 30 may comprise a single-level or multi-level floor 71. The oil pan 30, for example may comprise an upper level 36 and a sump 38. The floor 71 has a higher elevation in the upper level 36 and a lower elevation in the sump 38. The floor 71 may be tilted for gravity feed from the upper level 36 into the sump 38. As shown there may be one or more upper levels 36 and they may be at the same or differing elevations.

With additional reference to FIG. 2, the interaction of the tray 50 and oil pan 30 may be described. The windage tray 50 comprises the plurality of tabs 54. The oil pan 30 comprises the corresponding pockets 44. The tabs 54 fit within the pockets 44, and the tabs 54 may be loosely positioned within the pockets 44 to provide clearance for positioning therein.

Referring now to FIG. 4, a perspective view of the windage tray 50 is shown. The tray 50 corresponds to the shape of the opening in the oil pan and the bottom crankcase are of the engine block 12. The windage tray 50 has a plurality of edges 52 which define the perimeter of the tray 50 and a plurality of tabs 54 which extend from the edges 52.

Within the perimeter of the edges 52, the windage tray 50 includes a curved panel 58. The panel 58 follows the curvature of the crank rotation. The curvature of the panel approximates that of the diameter and path of the crankshaft rotation. Thus, the radius of the curvature may be larger if a larger crankshaft is used, for example with higher horsepower, higher performance engines. The curved panel 58 may have a plurality of apertures 57 for returning oil that slings from the crank. The oil is able to pass through the panel 58 via the plurality of apertures 57 into the oil pan 30. According to some embodiments, each aperture may have a cover 59, spaced from the upper surface of panel 58 to allow oil to pass to the aperture 57 and into the oil pan 30. Covering the aperture 57 again limits impact of the wind and pressure from the crank in the oil pan 30. The panel 58 may have one or more notches or openings to accept additional features such as an oil pick up or the like.

Disposed along one or more edges of the windage tray 50 are a plurality of scrapes 61. The scrapes 61 extend upwardly from the windage tray 50 and are in close proximity to the rotating crankshaft. As a result, the scrapes 61 function, in part, to cause oil removal from the crankshaft and direct the hole through the apertures 57. Likewise, the covers 59 may also functionally remove oil, without touching the crankshaft, and thereby also cause the oil to pass through the aperture 57.

One or more clearance features 63 may be disposed about the tray 50 or within the panel 58 to allow passage by, or through, of a pickup tube assembly (not shown).

The tabs 54 are engaged on a bottom by the inserts 48 to maintain a biasing force on the bottom of the panel 58. The insert 48 prevents direct contact between the tabs 54 and the oil pan 30 and further provide a vibration damping function.

The tabs 54 may be formed of various shapes as previously described. For not limited example, the instant tabs 54 may comprise four shapes. A first shape 62 of the tabs 54 have be a trapezoidal shape with one angles side or a second shape 64 may include two angled sides. Others shapes 66 may be rectangular. Some tabs have angled edges that extend in a first direction or a second angled direction. All of these features aid to locate and orient the windage tray 50 relative to the oil pan 30.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the invent of embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

Unless otherwise indicated, all numbers expressing quantities of ingredients, properties such as reaction conditions, and so forth used in the specification and claims are to be understood as being modified in all instances by the term "about". Accordingly, unless indicated to the contrary, the numerical parameters set forth in this specification and claims are approximations that can vary depending upon the desired properties sought to be obtained by the presently-disclosed subject matter.

As used herein, the term "about," when referring to a value or to an amount of mass, weight, time, volume, concentration or percentage is meant to encompass variations of in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed method.

As used herein, ranges can be expressed as from "about" one particular value, and/or to "about" another particular value. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

The foregoing description of methods and embodiments has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended hereto.

The invention claimed is:

1. A windage tray, comprising:

a panel having a curved surface extending between a first edge and a second parallel edge;

a plurality of tabs disposed along each of said first edge and said second parallel edge;

said plurality of tabs having two or more shapes capable of orienting said panel relative to an oil pan;

at least one locator disposed along each of said first edge and said second parallel edge, said at least one locator turning downwardly from each said first edge and said second parallel edge wherein each said at least one locator is oriented in a different plane than said plurality of tabs, and each of said at least one locator is capable of engaging said oil pan differently than said plurality of tabs.

2. The windage tray of claim 1, said plurality of tabs comprising a first size tab and a second size tab.

3. The windage tray of claim 2, said plurality of tabs differing in orientation in at least two locations along each said first edge and said second parallel edge, so that the windage tray is capable of proper orientation in one direction.

4. The windage tray of claim 1, one of said plurality of tabs at one end of one of said first or second edges differs in size from a second of said plurality of tabs at a second end of said one of said first or second edges.

5. The windage tray of claim 1, said plurality of tabs comprising a single size.

6. The windage tray of claim 1, said at least one locator being angled relative to an adjacent tab to provide a centering function.

7. The windage tray of claim 1 further comprising a plurality of holes along one side of said windage tray.

8. The windage tray of claim 1 further comprises a plurality of apertures in said panel, at least one of the plurality of apertures having a cover spaced from the at least one aperture.

9. An oil pan assembly, comprising:

an oil pan with a flange about an upper perimeter of said oil pan;

a windage tray disposed along an inside upper perimeter of said oil pan;

a plurality of tabs disposed along each of two parallel edges of said windage tray, each of said plurality of tabs being free of apertures;

a plurality of pockets disposed along an upper surface of said flange, said plurality of pockets formed in said flange and being recessed relative to the upper surface of said flange so that each tab of said plurality of tabs is positioned in a corresponding pocket of said plurality of pockets;

at least one slot disposed in said plurality of pockets;

an insert disposed in each slot and engaging an undersurface of each of said plurality of tabs.

10. The oil pan assembly of claim 9, further comprising a locator at one end of each of said two parallel edges of said windage tray.

11. The oil pan assembly of claim 9, said flange further comprising a perimeter seat for a seal.

12. The oil pan assembly of claim 9, said plurality of tabs comprising at least a first size and a second size.

13. The oil pan assembly of claim 9, at least one tab of said plurality of tabs having a first orientation and at least one second tab of said plurality of tabs having a second orientation.

14. The oil pan assembly of claim 13, wherein said windage tray may only be properly seated in the flange in one direction.

* * * * *